US005263626A

United States Patent [19]

Howard et al.

[11] Patent Number: 5,263,626

[45] Date of Patent: Nov. 23, 1993

[54] FASTENER-DRIVING TOOL WITH ACTUATING STRUCTURE BIASED BY DUAL BIASING MEANS

[75] Inventors: Frank C. Howard, Mount Prospect; Robert J. Berry, Waukegan, both of Ill.

[73] Assignee: Illinois Tool Works Inc., Glenview, Ill.

[21] Appl. No.: 998,131

[22] Filed: Dec. 29, 1992

[51] Int. Cl.[5] ..... B25C 1/08

[52] U.S. Cl. ..... 227/8; 227/142

[58] Field of Search ..... 227/8, 142

[56] References Cited

U.S. PATENT DOCUMENTS

| | | | |
|---|---|---|---|
| 3,612,379 | 10/1971 | Panock | 227/8 |
| 4,523,646 | 6/1985 | Doyle et al. | 227/8 |
| 4,549,681 | 10/1985 | Yamamoto et al. | 227/8 |
| 4,821,937 | 4/1989 | Rafferty | 227/142 |
| 5,197,646 | 3/1993 | Nikolich | 227/8 |

*Primary Examiner*—Scott Smith

*Attorney, Agent, or Firm*—Schwartz & Weinrieb

[57] ABSTRACT

In a fastener-driving tool comprising a housing structure defining an axis and a nosepiece extending from the housing structure, a primary actuating structure is movable between a tool-disabling position and a tool-enabling position, and a secondary actuating structure is coactive with the primary actuating structure for moving the primary actuating structure to the tool-enabling position when the secondary actuating structure is pressed firmly against a workpiece. The primary actuating structure is biased to the tool-disabling position by a primary spring or springs. The secondary actuating structure is biased away from the primary actuating structure by secondary springs. When the secondary actuating structure is pressed firmly against a workpiece, the primary spring or springs exhibit a biasing force less than the biasing force exhibited by the secondary springs. The secondary actuating structure may also be biased away from the housing structure by a tertiary spring.

10 Claims, 5 Drawing Sheets

FASTENER-DRIVING TOOL WITH ACTUATING STRUCTURE BIASED BY DUAL BIASING MEANS

TECHNICAL FIELD OF THE INVENTION

This invention pertains to a fastener-driving tool, such as a nail-driving tool or a staple-driving tool, which has a novel construction enabling a user to vary the depths of penetration of successively driven fasteners. The fastener-driving tool may be pneumatically powered or combustion-powered and is useful particularly but not exclusively where vinyl siding or aluminum siding is being applied over an irregular or undulating surface.

BACKGROUND OF THE INVENTION

Fastener-driving tools, which may be pneumatically powered or combustion-powered, are used widely in building construction. Such pneumatically powered tools are exemplified in Golsch U.S. Pat. No. 4,932,480. Such combustion-powered tools are exemplified in Nikolich U.S. Patent Re. 32,452 and in Nikolich U.S. patent application Ser. No. 07/848,277 filed Mar. 9, 1992.

Typically, such a pneumatically powered or combustion-powered tool comprises a housing structure, a nosepiece extending from the housing structure, a primary actuating structure, and a secondary actuating structure. The primary actuating structure is movable between a tool-disabling position relative to the housing structure and a tool-enabling position relative thereto and is biased to the tool-disabling position. The secondary actuating structure is movably mounted upon the nosepiece. The primary actuating structure is arranged to enable the tool when such structure is moved to the tool-enabling position and to disable the tool when such structure is moved from the tool-enabling position. The secondary actuating structure is arranged to move the primary actuating structure to the tool-enabling position when the secondary actuating structure is pressed firmly against a workpiece. Typically, the fastener-driving tool also comprises a trigger, which must be manually actuated after the tool has been enabled by the primary actuating structure.

Commonly, such a fastener-driving tool is used for fastening new siding material, such as vinyl siding or aluminum siding, over an older building structure, which may have an irregular or undulating surface. Aesthetically, it is important for the lower surface of the siding material to be substantially flat and not to follow the contour of an irregular or undulating surface, over which the siding material may be applied. However, if a fastener is driven through the siding material, into an underlying structure where the underlying structure has a depression, to a maximum depth of penetration of the fastener, the fastener tends to draw the siding material into the depression.

Because the primary actuating structure is biased to the tool-disabling position, because the secondary actuating structure is movable conjointly with the primary actuating structure, and because the secondary actuating structure must be firmly pressed against the siding material to enable the tool, the tool cannot be moved away from the siding material by more than a very small distance without disabling the tool. It is not practicable, therefore, to change the depth of the penetration of the fastener to be driven next by moving the tool away from the siding material.

Hence, there has been a need for a fastener-driving tool enabling a user to drive successive fasteners to varying depths of penetration, as where new siding material is being applied over an irregular or undulating surface. This invention is addressed to that need.

SUMMARY OF THE INVENTION

This invention provides a novel combination in a fastener-driving tool comprising a housing structure, a nosepiece extending from the housing structure, a primary actuating structure, and a secondary actuating structure. The primary actuating structure is movable between a tool-enabling position relative to the housing structure and a tool-disabling position relative thereto and is biased to the tool-disabling position. The primary actuating structure enables the tool when moved to the tool-enabling position and disables the tool when moved away from the tool-enabling position. The secondary actuating structure is movably mounted upon the nosepiece and is coactive with the primary actuating structure so as to move the primary actuating structure to the tool-enabling position when the secondary actuating structure is pressed firmly against a workpiece.

According to this invention, the primary actuating structure is biased to the tool-disabling position by primary biasing means, and the secondary actuating structure is biased away from the primary actuating structure by secondary biasing means. These biasing means are arranged so that, when the secondary actuating structure is pressed firmly against a workpiece, the primary biasing means exhibits a biasing force less than the biasing force exhibited by the secondary biasing means. The housing structure can then be moved toward and away from the workpiece, over a limited range of relative movement so as to vary the depths of penetration of successively driven fasteners, without disabling the tool. The fasteners may be nails or staples.

In one contemplated embodiment, a structure is adjustably mounted to the workpiece-contacting member for conjoint movement with the workpiece-contacting member, and the secondary biasing means includes a spring compressible between the adjustably mounted structure and the primary actuating structure. The secondary biasing means may comprise two coiled springs, each being compressible between the adjustably mounted structure and the primary actuating structure.

In another contemplated embodiment, an intermediate structure is movably mounted upon the nosepiece and is engaged with the primary actuating structure. Therein, the intermediate and secondary actuating structures are movable independently along the nosepiece, and the secondary biasing means acts between the intermediate and secondary actuating structures.

Preferably, the primary biasing means includes at least one spring compressible between the housing structure and the primary actuating structure. Two alternative arrangements are contemplated, namely one wherein the primary biasing means comprises a single coiled spring compressible between the housing structure and the primary actuating structure and another wherein the primary biasing means comprises two coiled springs, each being compressible between the housing structure and the primary actuating structure.

Moreover, if the intermediate structure is included, the primary actuating structure may also be biased away from the housing structure by tertiary biasing means including at least one spring compressible between the housing structure and the intermediate structure.

BRIEF DESCRIPTION OF THE DRAWINGS

These and other objects, features, and advantages of this invention will become evident from the following description of two contemplated embodiments of this invention with reference to the accompanying drawings in like reference characters designate like or corresponding parts throughout the several views, and wherein.

DETAILED DESCRIPTION OF ILLUSTRATED EMBODIMENTS

Figure 1:
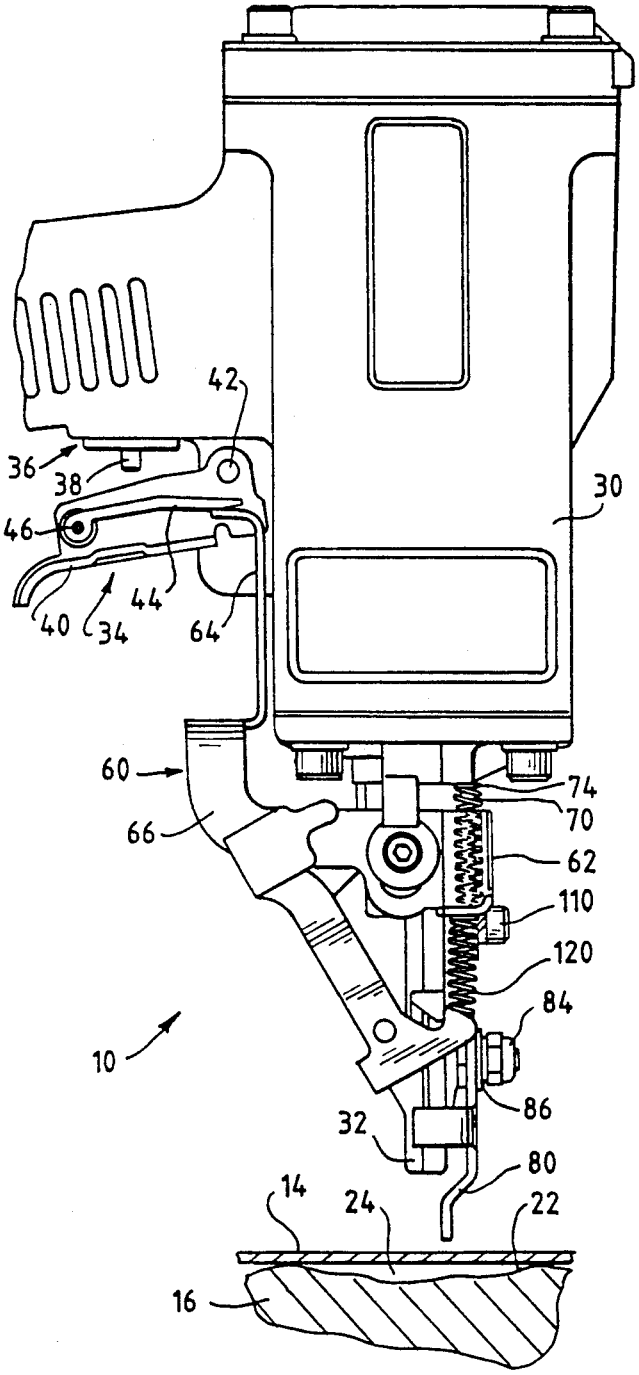
FIG. 1 is a fragmentary, side elevation of a pneumatically powered, staple-driving tool embodying this invention. A workpiece, such a piece of aluminum siding, and a substrate are shown fragmentarily.

As shown in FIGS. 1 through 6, this invention may be advantageously embodied in a pneumatically powered, staple-driving tool 10, which is shown being used to drive staples 12 through a piece of aluminum siding 14, into an underlying substrate 16. Each staple 12 has two pointed legs 18 and a head 20 connecting the staple legs 18. As shown in FIGS. 1 through 4, the substrate 16 may not be entirely flat but may have an irregular or undulating surface 22 with depressions 24, particularly if the substrate 16 is an older building structure. Although it is convenient to illustrate the tool 10 in a vertical orientation, as in FIGS. 1 through 6, the tool 10 may also be used if rotated from the vertical orientation (by one quarter turn, by one half-turn, or otherwise) in a counterclockwise direction in the plane of FIG. 1. Herein, "upper", "lower", and other directional terms refer to the tool 10 in the vertical orientation and are not intended to limit this invention to any particular orientation.

Figure 3:
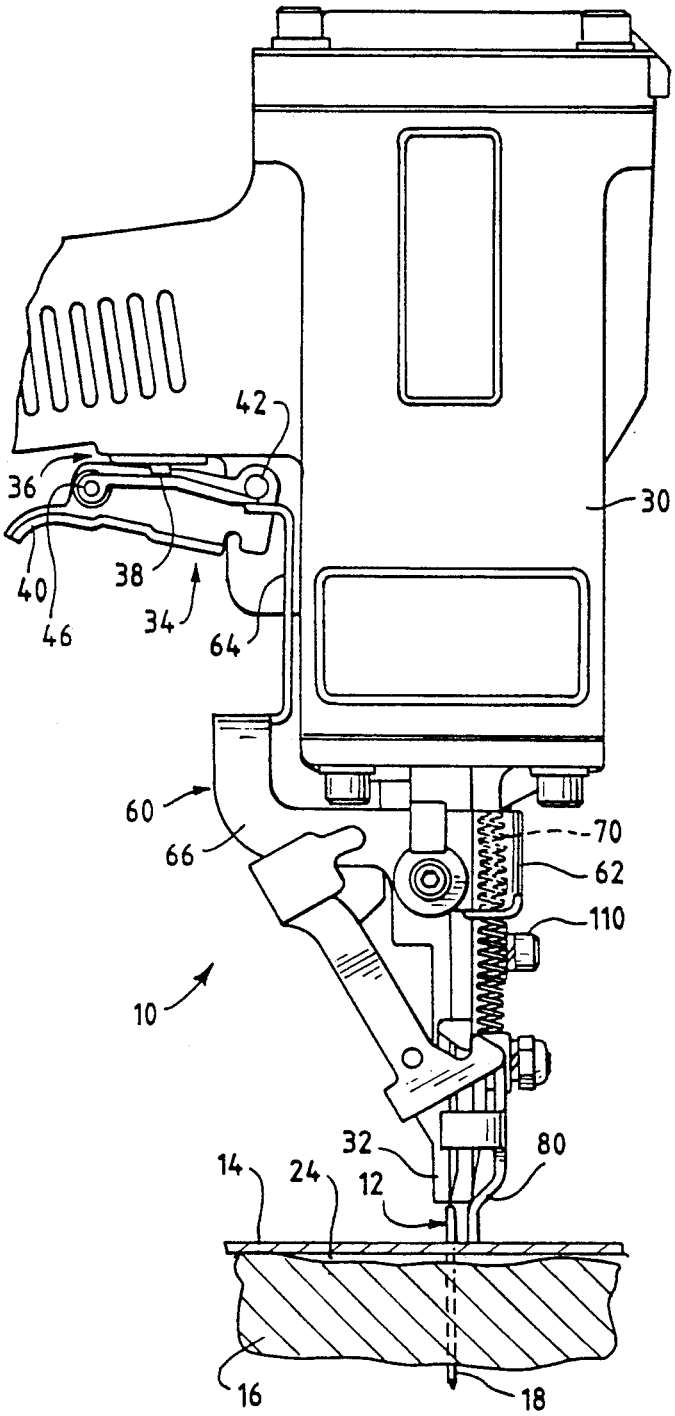
FIG. 3 is a view similar to FIG. 1 but showing certain structures of the tool in a first set of changed positions with a staple driven through the workpiece, into the substrate where the substrate has a depression, to a partial depth of penetration.
Figure 4:
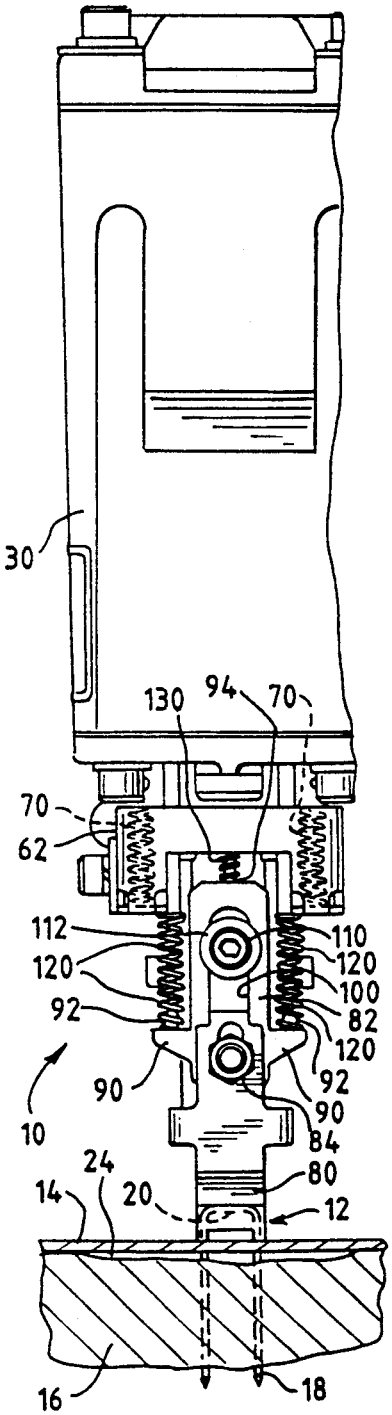
FIG. 4 is a view similar to FIG. 2 but showing certain structures of the tool in the first set of changed positions.
Figure 5:
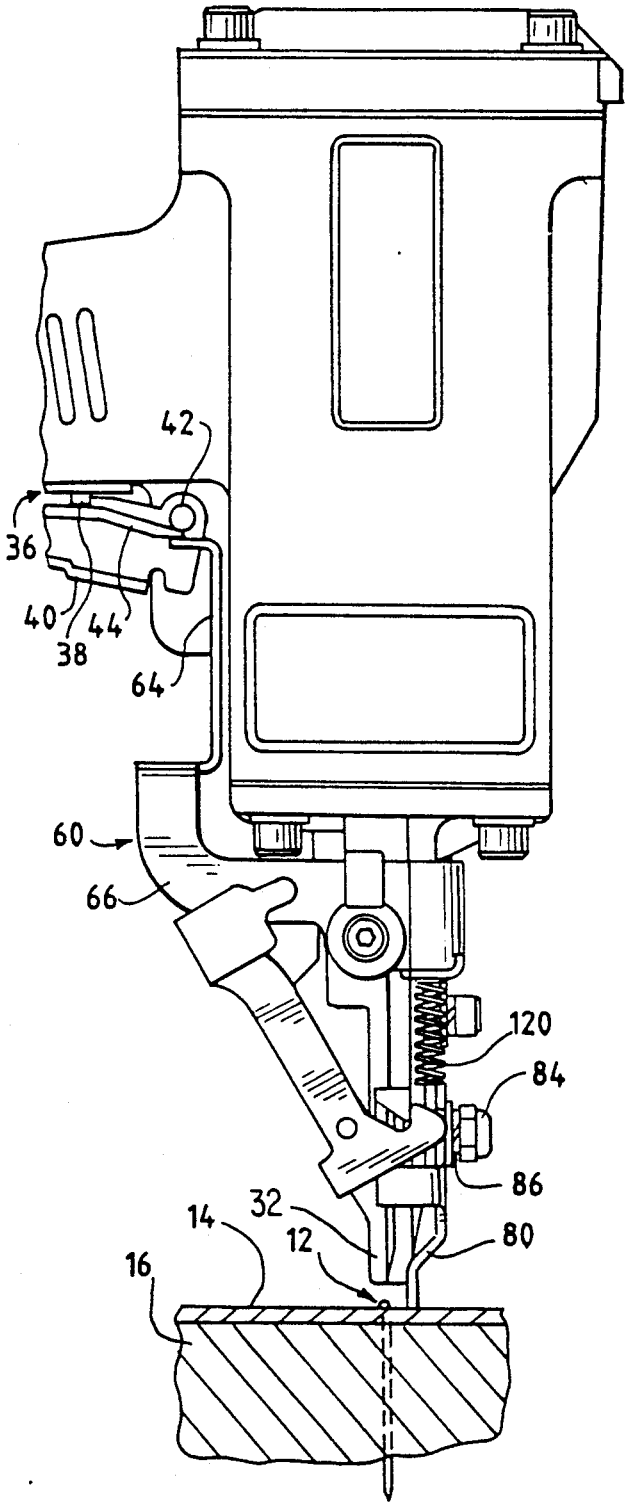
FIG. 5 is a view similar to FIGS. 1 and 3 but showing certain structures of the tool in a second set of changed positions with a staple driven through the workpiece, into the substrate where the substrate has a flat surface, to a full depth of penetration.
Figure 6:
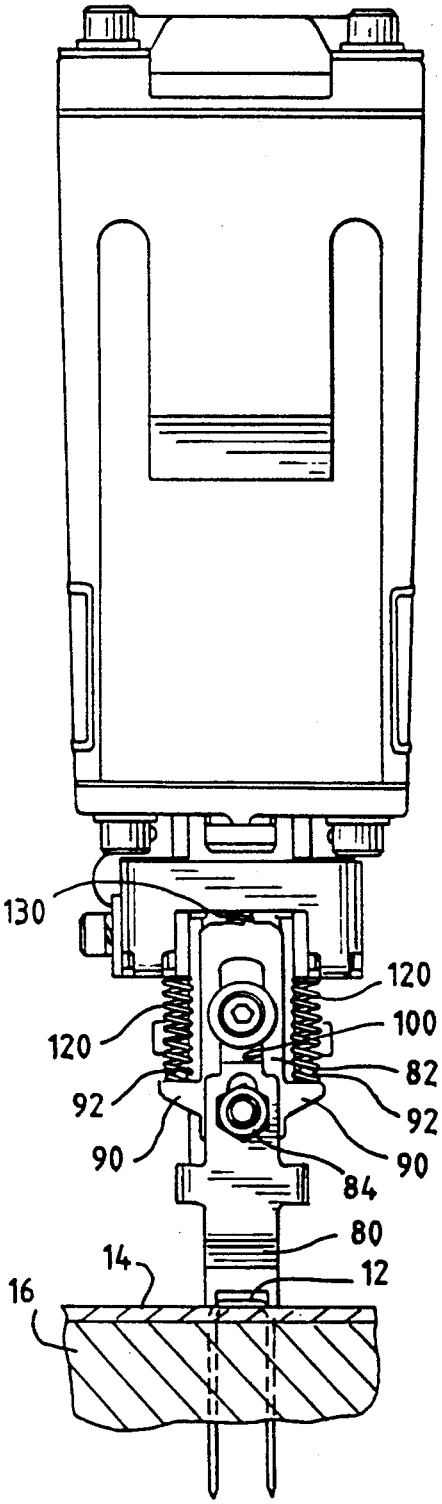
FIG. 6 is a view similar to FIGS. 2 and 4 but showing certain structures of the tool in the second set of changed positions.

As shown in FIGS. 3 and 4, the tool 10 is operable in a first mode to drive a staple 12 through the siding 14, into the substrate 16 where the substrate surface 22 has an underlying depression 24, to a partial depth of penetration of the staple 12. Because the staple head 20 is left standing above the siding 14, the staple 12 does not tend to draw the siding 14 into the underlying depression 24. As shown in FIGS. 5 and 6, the tool 10 is operable in a second mode to drive a staple 12 through the siding 14, into the substrate 16 where the substrate surface 22 is flat, to a full depth of penetration of the staple 12. Thus, the staple head 20 is flush with the siding surface 22.

Broadly, the tool 10 comprises a housing structure 30 defining a tool axis, a nosepiece 32 extending axially from the housing structure 30, a trigger mechanism 34 mounted operatively upon the housing structure 30, and a pneumatic valve 36 mounted operatively upon the housing structure 30 and comprising an actuating plunger 38. The trigger mechanism 34 includes a manually actuatable trigger 40, which is mounted pivotally to the housing structure 30 by means of pivot pin 42, an a lever, 44, which is mounted pivotally to the trigger 40 by means of a pivot pin 46. The trigger 40 is pivotable between a deactuated position, in which it is shown in FIG. 1, and an actuated position, in which it is shown in FIGS. 3 and 5. The lever 44 is pivotable between an inoperative position, in which it is shown in FIG. 1, and an operative position, in which it is shown in FIGS. 3 and 5.

If the trigger 40 is pivoted manually to its actuated position after the lever 44 has been pivoted to its operative position in a manner described below, the pneumatic valve 36 is actuated by means of the actuating plunger 38, which is depressed by the lever 44. Pressurized air is admitted into the tool 10, through means of the pneumatic valve 36, so as to drive a piston (not shown) and a driving blade (not shown) conjointly. The piston and the driving blade have a fixed stroke length. Thus, the tool 10 drives a staple 12 through the siding 14, into the substrate 16. Staples 12 are supplied to the tool 10 from a magazine (not shown) mounted upon the housing structure 30. However, if the trigger 40 is pivoted to its actuated position when the lever 44 is not in its operative position, the pneumatic valve 36 is not actuated.

As described in the preceding two paragraphs, except for the manner in which the lever 44 is pivoted to its actuated position, the tool 10 is similar to pneumatically powered staple-driving tools available commercially from ITW Paslode (a unit of Illinois Tool Works Inc.) of Lincolnshire, Ill., under its PASLODE trademark. Thus, except as illustrated and described herein, other structural and functional details of the tool 10 can be readily supplied by persons having ordinary skill in the art and are outside the scope of this invention.

Figure 2:
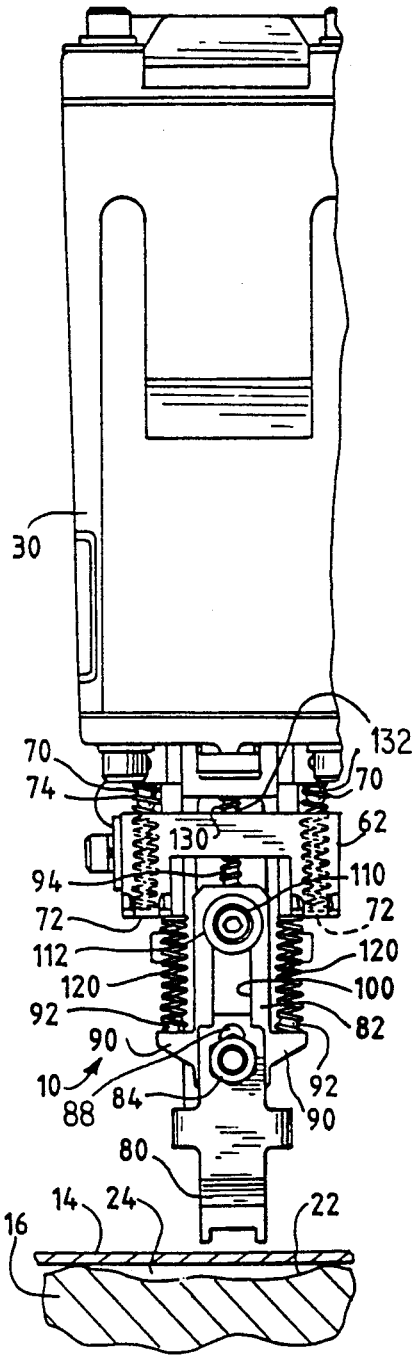
FIG. 2 is a fragmentary, front elevational view of the tool, the workpiece, and the substrate, as shown in FIG. 1.

Further, the tool 10 comprises a primary actuating structure 60 having a mounting portion 62, an actuating portion 64 engaging the lever 44 of the trigger mechanism 34, and a connecting portion 66 connecting the mounting portion 62 to the actuating portion 64. The mounting portion 62 is mounted upon the nosepiece 32 so as to enable the structure 60 to be axially movable between a lower, tool-disabling position, in which the structure 60 is shown in FIGS. 1 and 2, and an upper, tool-enabling position, in which the structure 60 is shown in FIGS. 3, 4, 5, and 6.

Thus, the primary actuating structure 60 is arranged so that the actuating portion 64 pivots the lever 44 from its inoperative position to its operative position when the structure 60 is moved to its tool-enabling position. Also, the structure 60 is arranged so that the actuating portion 64 permits the lever 44 to move from its operative position when the structure 60 is moved away from its tool-enabling position.

The primary actuating structure 60 is biased to its lower, tool-disabling position by primary biasing means comprised of two coiled springs 70, each of which is compressible between the housing structure 30 and the mounting portion 62. Each spring 70 has a lower end, which bears against an upper surface of a lower wall 72 of the mounting portion 62, and an upper end, which is piloted over a pintle 74 extending from the housing structure 30 so as to bear against the housing structure 30. Thus, the springs 70 act as parallel springs, which have an effective spring constant that is relatively low compared to the relatively high, effective spring constant of parallel springs to be later described.

Moreover, the tool 10 comprises a secondary actuating structure 80 and a structure 82, which is adjustably mounted upon the structure 80 for conjoint, axial movement with the structure 80. The structure 82 is adjustably mounted upon the structure 89 by means of a machine screw 84, which has a shank (not shown) having a threaded end and extending through a washer 86, through an elongate slot 88 in the structure 80, and into a threaded socket (not shown) in the structure 82. Near its lower end, the structure 82 has two lateral ears 90, each mounting a pintle 92 extending axially toward the housing structure 30. Also, the structure 82 mounts a pintle 94 extending axially from its upper end, toward the housing structure.

The secondary actuating structure 80 and the adjustably mounted structure 82 are mounted upon the nosepiece 32 so as to be conjointly movable between a fully extended position, in which the structures 80, 82, are shown in FIGS. 1 and 2, and a fully retracted position, in which the structures 80, 82, are shown in FIGS. 5 and 6. The structures 80, 82, are movable conjointly through a range of partially retracted positions, as exemplified by the partially retracted position in which the structures 80, 82, are shown in FIGS. 3 and 4.

The adjustably mounted structure 82 has an elongate slot 100, which is closed at its lower and upper ends. A stud 110 has a shank (not shown) having a threaded end and extending through a washer 112, through the slot 100, and into a threaded socket (not shown) in the nosepiece 32. The stud 110 coacts with the structure 82, at the upper end of the slot 100, and with the upper end of the secondary actuating structure 80 to limit the range of conjoint movement of the structures 80, 82, relative to the nosepiece 32.

The secondary actuating structure 80 and the adjustably mounted structure 82 are biased conjointly away from the primary actuating structure 60, to the fully extended position, by secondary biasing means comprised of two coiled springs 120, each of which is compressible between the adjustably mounted structure 82 and the primary actuating structure 60. Each spring 120 has a lower end, which is piloted over the pintle 92 on one of the lateral ears 90 of the adjustably mounted member 82 so as to bear against the member 82, and an upper end, which bears against a lower surface of the lower wall 72 of the mounting portion of the tool-actuating member 60. Thus, the springs 120 act as parallel springs, which effectively have a spring constant that is relatively high compared to the relatively low, effective spring constant of the parallel springs 70.

The secondary actuating structure 80 and the adjustably mounted structure 82 are also biased conjointly away from the housing structure 30 by tertiary biasing means comprised of a coiled spring 130 compressible between the adjustably mounted structure 82 and the housing structure 30. The spring 130 has an upper end, which is piloted over a pintle 132 extending from the housing structure 30, and a lower end, which is piloted over the pintle 94 at the upper end of the adjustably mounted structure 82.

When the secondary actuating structure 80 is pressed firmly against a workpiece, such as the siding 14, each of the springs 70, 120, 130, is compressed so that each of the primary, secondary, and tertiary biasing means exhibits a biasing force. Because the spring constants of the springs 70 are lower than the spring constants of the springs 120, as noted above, the biasing force exhibited by the primary biasing means comprised of the springs 70 is less than the biasing force exhibited by the secondary biasing means comprised of the springs 120.

Ordinarily, as suggested by FIGS. 5 and 6, the secondary actuating structure 80 is pressed initially against the workpiece with sufficient force not only to move the primary actuating structure 60 to the operative position but also to move the secondary actuating structure 80 and the adjustably mounted structure 82 conjointly to the fully retracted position. Because the biasing force exhibited by the secondary biasing means is greater than the biasing force exhibited by the primary biasing means, the housing structure 30 can then be moved away from the workpiece, over a limited range of housing structure movement, without disabling the tool 10.

Alternatively, as suggested by FIGS. 2 and 3, the secondary actuating structure 80 can be initially pressed against the workpiece with sufficient force to move the primary actuating structure 60 to the operative position but not to move the structures 80, 82, conjointly beyond a partially retracted position. Because the biasing force exhibited by the secondary biasing means is greater than the biasing force exhibited by the primary biasing means, the housing structure 30 can then be moved toward and away from the workpiece, over the same range of housing structure movement, without disabling the tool 10.

In either instance, because the stroke length of the piston and the driving blade noted above is fixed, the depths of penetration of successively driven staples 12 can thus be adjusted, over a limited range of depth adjustment, without disabling the tool 10.

The tertiary biasing means comprised of the spring 130 helps to return the secondary actuating structure 80 and the adjustably mounted structure 82 conjointly to the fully extended position when the secondary actuating structure 80 is removed from the workpiece. The spring 130 does not act directly on the primary actuating structure 60.

Figure 7:
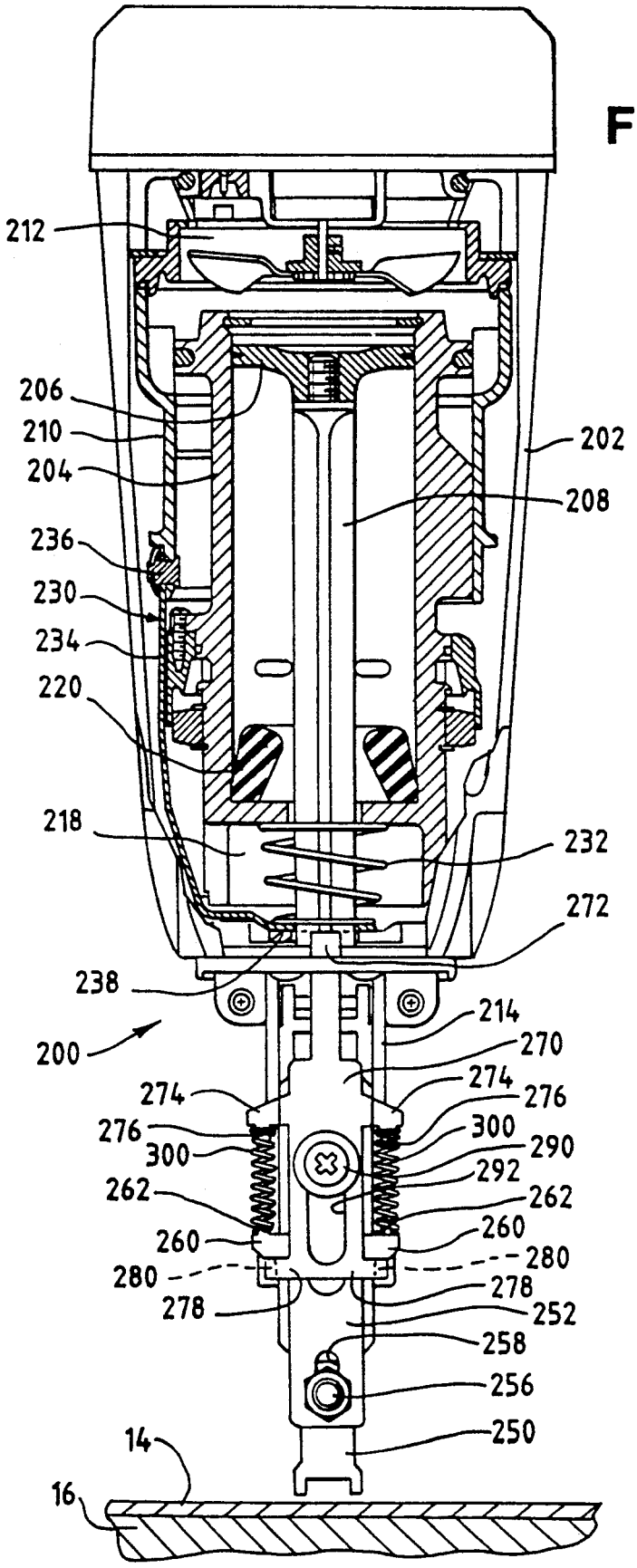
FIG. 7 is a sectional view of a combustion-powered, staple-driving tool embodying this invention. A workpiece, such a piece of aluminum siding, and a substrate are shown fragmentarily.
Figure 8:
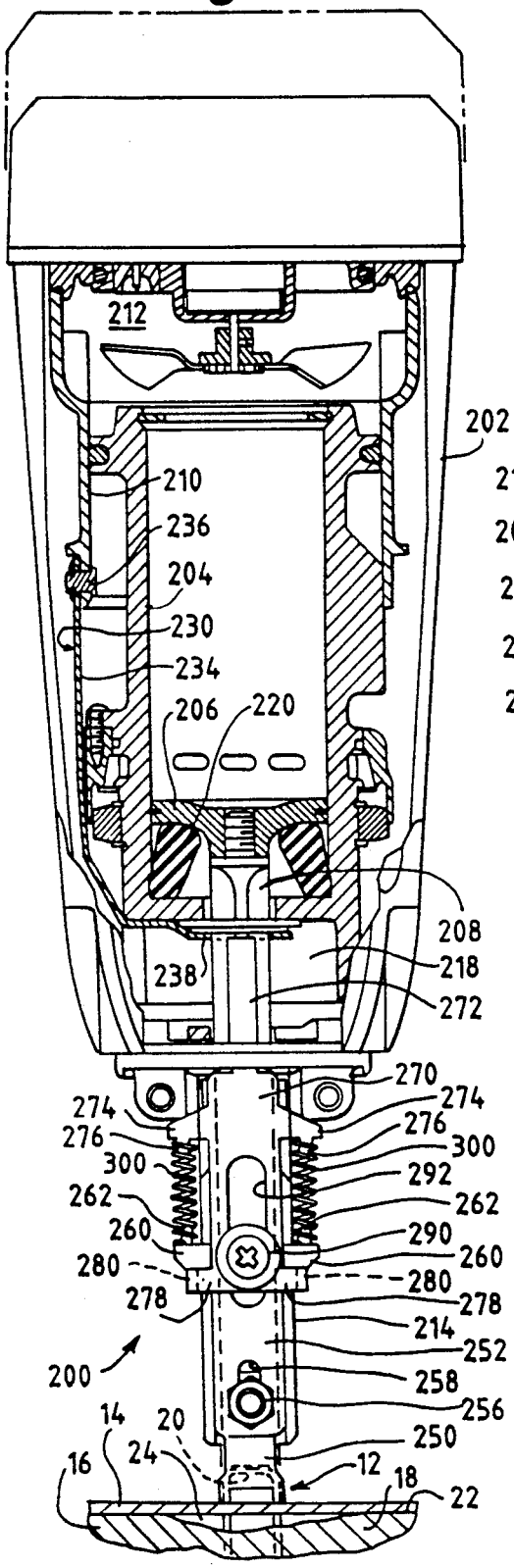
FIG. 8 is a view similar to FIG. 7 but showing certain structures of the tool in a second set of changed positions with a staple driven through the workpiece, into the substrate where the substrate has a depression, to a partial depth of penetration.
Figure 9:
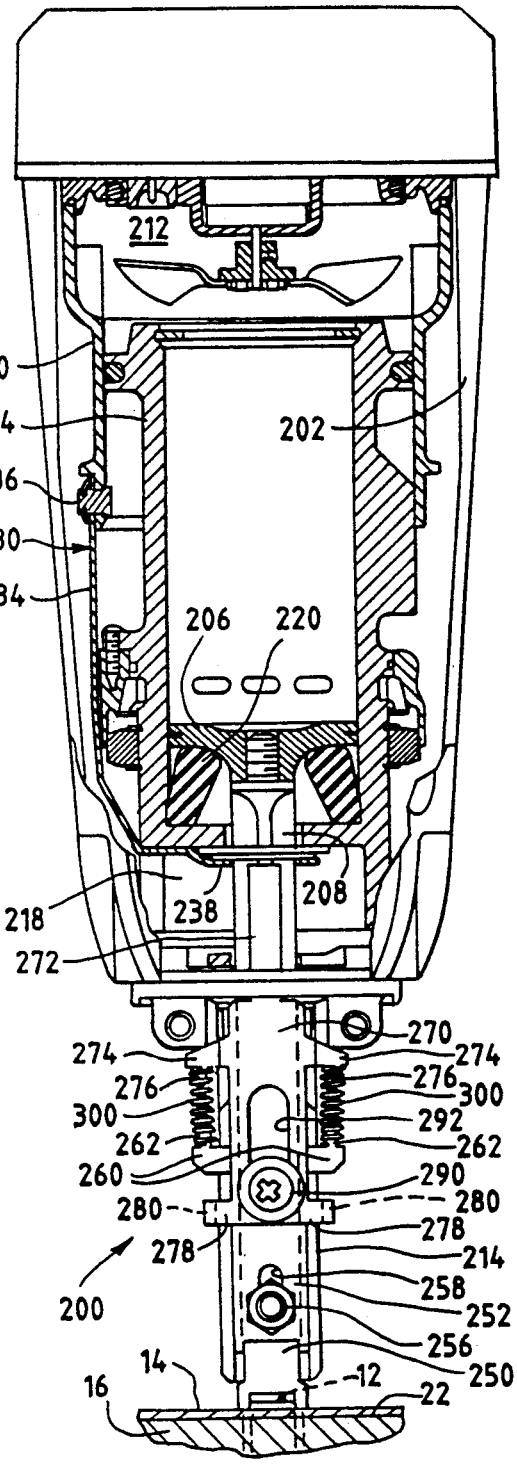
FIG. 9 is a view similar to FIGS. 7 and 8 but showing certain structures of the tool in a second set of changed positions with a staple driven through the workpiece, into the substrate where the substrate has a depression, to a full depth of penetration.

As shown in FIGS. 7, 8, and 9, this invention may be alternatively embodied in a combustion-powered, staple driving tool 200, which also is shown being used to drive staples 12 through a piece of aluminum siding 14, into an underlying substrate 16. The substrate 16 again may not be entirely flat but may have an irregular or undulating surface 22 with depressions 24. Although it is convenient to illustrate the tool 200 in a vertical orientation, as in FIGS. 7, 8, and 9, the tool 200 may be also used if rotated from the vertical orientation.

As shown in FIG. 8, the tool 200 is operable in a first mode to drive a staple 12 through the siding 14, and into the substrate 16 where the substrate surface 22 has an underlying depression 24, to a partial depth of penetration of the staple 12. Because the staple head 20 is left standing above the siding 14, the staple 12 does not tend to draw the siding 14 into the underlying depression 24. As shown in FIG. 9, the tool 200 is operable in a second mode to drive a staple 12 through the siding 14, and into the substrate 16 where the substrate surface 22 is flat, to a full depth of penetration of the staple 12. Thus, the staple head 20 is flush with the siding surface 22.

The tool 200 comprises a housing structure 202, within which a cylinder body 204 is fixedly mounted. The cylinder body 204 defines a tool axis. A piston 206 is operatively mounted in the cylinder body 204. The piston 206 is arranged to drive a driving blade 208 extending axially from the cylinder body 204. A valve sleeve 210 is mounted in axially movable relation to the cylinder body 204. The cylinder body 204 and the valve sleeve 210 define a combustion chamber 212. The valve sleeve 210 is axially movable along the cylinder body 204, so as to open and close the combustion chamber 212. A nosepiece 214 is mounted upon the housing structure 202, in axially spaced relation to the cylinder body 204. A lower chamber 218 is defined between the cylinder body 204 and the nosepiece 214. A resilient bumper 220 is disposed within the cylinder body 204 for arresting the piston 206.

A primary actuating structure 230 is provided for closing the combustion chamber 212 when a secondary actuating structure to be later described is pressed firmly against a workpiece, such as the siding 14. The structure 230 includes four arms 234 (one shown) connected to the valve sleeve 210 by fasteners 236 (one shown) so as to be conjointly movable with the valve sleeve 210. The structure arms 234 are connected to each other and to the secondary actuating structure 250 by an annular member 238 disposed within the lower chamber 218 and across the tool axis. The structure arms 234 are shaped so as to extend outwardly from the lower chamber 218 and upwardly along the cylinder body 204.

A coiled spring 232, which is disposed within the lower chamber 218, is compressible between the cylinder body 204 and the annular member 238 of the primary actuating structure 230, so as to bias the valve sleeve 210 by means of the structure 230, to a tool-disabling position, in which the combustion chamber 212 is opened.

The lower chamber 218 provides axial clearance, such as, for example, about one inch of axial clearance, to permit a limited range of axial movement of the structure arms 234 and the annular member 238 relative to the cylinder body 204, the nosepiece 214, and the housing structure 202 between the tool-disabling position and a tool-enabling position, in which the combustion chamber 212 is closed. The tool 200 is disabled when the combustion chamber 212 is not closed. The tool 200 also comprises a manually actuatable trigger (not shown) which must also be actuated,, after the combustion chamber 212 has been closed to enable the tool 200, so as to operate the tool 200 for driving a staple 12.

As described in the preceding three paragraphs, except for the manner in which the structure 230 is moved to the tool-enabling position, the tool 10 is similar to combustion-powered, staple-driving tools available commercially from ITW Paslode, supra, under its IMPULSE trademark. Thus, except as illustrated and described herein, other structural and functional details of the tool 200 can be readily supplied by persons having ordinary skill in the art and are outside the scope of this invention.

It is convenient to refer to the spring 232 noted above as constituting primary biasing means for biasing the primary actuating structure 230 to the tool-disabling position. The spring 232 has a relatively low spring constant, as compared to the relatively high, effective spring constant of parallel springs to be described later.

The tool 200 includes a secondary actuating structure 250 and a separate structure 252, which is mounted adjustably to the structure 250 for conjoint, axial movement of the structures 250, 252. A machine screw 256 has a shank (not shown) with a threaded end extending through a washer (not shown) and through an elongate slot 258 in the structure 252, into a threaded socket (not shown) in the structure 250 so as to adjustably attach the structures 250, 252, to each other. Near its upper end, the structure 252 has two lateral ears 260, each mounting a pintle 262 extending axially toward the housing structure 202.

The secondary actuating structure 250 is movable between a fully extended position, in which it is shown in FIG. 7, and a fully retracted position, in which it is shown in FIG. 9. The structure 250 is movable through a range of partially retracted positions, as exemplified by the partially retracted position in which it is shown in FIG. 8.

The tool 200 includes an intermediate structure 270 movably mounted upon the nosepiece 214. The intermediate structure 270 and the secondary actuating structure 250 are mounted so as to be independently movable along the nosepiece 214. At its upper end, the intermediate structure 270 includes an elongate, axially extending probe 272, which engages the primary actuating structure 230 at the annular member 238. Between its upper and lower ends, the intermediate structure 270 has two lateral ears 274, each mounting a pintle 276 extending axially toward the lower part of the secondary actuating structure 250. Each of the lateral ears 274 is spaced axially from one of the lateral ears 260 of the structure 252. At its lower end, the intermediate structure 270 has two lateral wings 278, each having a flange 280 extending across the lower edge of one of the lateral ears 260 on the structure 252.

A stud 290 has a shank (not shown) having a threaded end extending through a washer (not shown) and through an elongate slot 292 in the intermediate structure 270, through an elongate slot in the upper part 252 of the secondary actuating structure 250, and into a threaded socket (not shown) in the nosepiece 214. The slot 292 is open at its upper end. The stud 290 coacts with the intermediate structure 270, at opposite ends of the slot 292, to define a limited range of axial movement of the structure 270 relative to the nosepiece 214. Such range corresponds to the limited range of axial movement of the primary actuating structure 230 between the tool-disabling position and the tool-enabling position.

The flanges 280 on the wings 278 of the intermediate structure 270 coact with the lateral ears 260 of the structure 252 to limit axial movement of the structures 250, 252, to the fully extended position. The stud 256 coacts with the structure 250 at the lower end of the slot 258 to limit axial movement of the structures 250, 252, inwardly along the nosepiece 214, to the fully retracted position. Thus, the structures 250, 252, also have a limited range of conjoint, axial movement between the fully extended and fully retracted positions.

The secondary actuating structure 250 and the adjustably mounted structure 252 are biased away from the primary actuating structure 230, to the fully extended position, by secondary biasing means comprised of two coiled springs 300, each of which is compressible between the intermediate structure 270 and the structure 252. Each spring 300 has a lower end, which is piloted over the pintle 262 on one of the lateral ears 260 of the structure 252, and an upper end, which is piloted over the pintle 276 on one of the lateral ears 274 of the intermediate structure 270.

Effectively, as parallel springs, the springs 300 have a relatively high spring constant compared to the relatively low spring constant of the spring 232 constituting primary biasing means. The biasing force exhibited by the primary biasing means comprised of the spring 232 is less than the biasing force exhibited by the secondary biasing means comprised of the springs 300.

Ordinarily, as suggested by FIG. 9, the secondary actuating structure 250 is initially pressed against the workpiece with sufficient force to move the primary actuating structure 230 to the operative position, to move the intermediate structure 270 to the upper limit of its range of axial movement, and to move the structures 250, 252, conjointly to the fully retracted position. Because the biasing force exhibited by the secondary biasing means 300 overcomes the biasing force exhibited by the primary biasing means 232, the housing structure 202 can then be moved away from the workpiece, over a limited range of housing structure movement, without disabling the tool 200.

Alternatively, as suggested by FIG. 8, the secondary actuating structure 250 can be initially pressed against the workpiece with sufficient force so as to move the primary actuating structure 230 to the operative position and to move the intermediate structure 270 to the upper limit of its range of axial movement but not to move the structures 250, 252, conjointly beyond a partially retracted position. Because the biasing force exhibited by the secondary biasing means 300 is greater than the biasing force exhibited by the primary biasing means 232, the housing structure 202 can then be moved toward and away from the workpiece, over the same range of housing structure movement, without disabling the tool 200.

Although each embodiment described above is a staple-driving tool, this invention may be also embodied in a nail-driving tool, which may be pneumatically powered or combustion-powered. Various modifications may be also made departing from the scope and spirit of this invention. It is therefore to be understood that within the scope of the appended claims, the present invention may be practiced otherwise than as specifically described herein.

We claim:

1. A fastener-driving tool, comprising:

a housing structure;

a nosepiece extending from said housing structure;

a primary actuating structure, movable between a tool-enabling position relative to said housing structure and a tool-disabling position relative to said housing structure and biased toward said tool-disabling position, for enabling said tool when said primary actuating structure is moved to said tool enabling position and for disabling said tool when said primary actuating structure is moved away from said tool-enabling position;

a secondary actuating structure movably mounted upon said nosepiece independent of said primary actuating structure but capable of movement coactive with said primary actuating structure so as to move said primary actuating structure to said tool-enabling position when said secondary actuating structure is pressed firmly against a workpiece;

primary biasing means interposed between said housing structure and said primary actuating structure for biasing said primary actuating structure toward said tool-disabling position with a first biasing force; and second biasing means interposed between said primary actuating structure and said secondary actuating structure for biasing said secondary actuating structure away from said primary actuating structure with a biasing force which is greater than said biasing force exhibited by said primary biasing means whereby once said tool has been pressed against a workpiece so as to move said primary actuating structure to said tool-enabling position, said housing structure can be moved away from said workpiece, within a limited range of housing structure movement, without permitting said primary actuating structure to move away from said tool-enabling position so as not to disable said tool and thereby permit the depth of penetration of a fastener-to-be-driven to be adjusted.

2. The fastener-driving tool of claim 1, wherein:

said secondary actuating structure comprises a structure adjustably mounted upon said secondary actuating structure for conjoint movement with said secondary actuating structure;

said secondary biasing means including at least one spring compressible between said adjustably mounted structure and said primary actuating structure.

3. The fastener-driving tool of claim 2 wherein the secondary biasing means comprises two coiled springs, each of which is compressible between the adjustably mounted structure and the primary actuating structure.

4. The fastener-driving tool of claim 2 wherein the secondary actuating structure is biased away from the housing structure by tertiary biasing means including at least one spring compressible between the housing structure and the adjustably mounted structure.

5. The fastener-driving tool of claim 1 wherein the primary biasing means comprises at least one spring compressible between the housing structure and the primary actuating structure.

6. The fastener-driving tool of claim 5 wherein the primary biasing means comprises two coiled springs, each of which is compressible between the housing structure and the primary actuating structure.

7. The fastener-driving tool of claim 1, further comprising:

an intermediate structure movably mounted upon said nosepiece and engaged with said primary actuating structure;

said intermediate and secondary actuating structures being movable independently along said nosepiece; and said secondary biasing means including at least one spring compressible between said intermediate and secondary actuating structures.

8. The fastener-driving tool of claim 7 wherein the secondary biasing means included two coiled springs compressible between the intermediate and secondary actuating structures.

9. The fastener-driving tool of claim 7 wherein the primary biasing means comprises a single spring compressible axially between the housing structure and the primary actuating structure.

10. The fastener-driving tool as set forth in claim 9, wherein:

said fastener-driving tool comprises a combustion-powered fastener-driving tool wherein said housing structure comprises a cylinder body, a piston movable within said cylinder body, and a combustion chamber for generating combustion gases for driving said piston within said cylinder body; and said single spring of said primary biasing means is interposed between said primary actuating structure and said cylinder body.

* * * * *